US010006631B2

(12) United States Patent
Yamamoto et al.

(10) Patent No.: US 10,006,631 B2
(45) Date of Patent: Jun. 26, 2018

(54) METHOD FOR STARTING UP PRESSURIZED FLUIDIZED BED INCINERATOR SYSTEM

(71) Applicants: TSUKISHIMA KIKAI CO., LTD., Tokyo (JP); SANKI ENGINEERING CO., LTD., Tokyo (JP)

(72) Inventors: Takafumi Yamamoto, Tokyo (JP); Kazuyoshi Terakoshi, Tokyo (JP); Kunihiko Koga, Tokyo (JP); Isamu Orito, Tokyo (JP)

(73) Assignees: TSUKISHIMA KIKAI CO., LTD., Tokyo (JP); SANKI ENGINEERING CO., LTD., Tokyo (JP)

( * ) Notice: Subject to any disclaimer, the term of this patent is extended or adjusted under 35 U.S.C. 154(b) by 742 days.

(21) Appl. No.: 14/387,184

(22) PCT Filed: Mar. 22, 2013

(86) PCT No.: PCT/JP2013/058328

§ 371 (c)(1),
(2) Date: Sep. 22, 2014

(87) PCT Pub. No.: WO2013/146597

PCT Pub. Date: Oct. 3, 2013

(65) Prior Publication Data

US 2015/0040808 A1 Feb. 12, 2015

(30) Foreign Application Priority Data

Mar. 26, 2012 (JP) ..... 2012-069487

(51) Int. Cl.
*F23G 5/30* (2006.01)
*F23G 5/44* (2006.01)
(Continued)

(52) U.S. Cl.
CPC ..... *F23G 5/30* (2013.01); *F23C 10/16* (2013.01); *F23C 10/18* (2013.01); *F23G 5/44* (2013.01);
(Continued)

(58) Field of Classification Search
CPC .... F23G 5/00; F23G 5/30; F23C 2900/10006; F23C 10/16; F23L 5/00
See application file for complete search history.

(56) References Cited

U.S. PATENT DOCUMENTS 3,761,568 A * 9/1973 Brink ..... C10B 53/00 201/27
4,584,949 A * 4/1986 Brannstrom ..... F23C 10/16 110/245
(Continued)

FOREIGN PATENT DOCUMENTS

JP S54119775 A1 9/1979
JP H06300237 A 10/1994
(Continued)

OTHER PUBLICATIONS

Translation of JP2008025966 to Shuichi et al. Machine translated on Mar. 9, 2017.*
(Continued)

*Primary Examiner* — David J Laux
(74) *Attorney, Agent, or Firm* — Muncy, Geissler, Olds & Lowe, P.C.

(57) ABSTRACT

Is provided a method for starting up a pressurized fluidized bed incinerator system by which cracking of silica sand as a bed material can be prevented at low costs. By heating the silica sand as the bed material filled up in a bottom portion of a pressurized fluidized bed incinerator, a temperature of a freeboard of the incinerator is heated, and after the temperature of the freeboard is heated to 750 to 900° C., a material to be treated having a water-containing organic substance is fed to the pressurized fluidized bed incinerator.

4 Claims, 6 Drawing Sheets

(51) Int. Cl.

| | |
|---|---|
| ***F23L 5/00*** | (2006.01) |
| ***F23G 5/50*** | (2006.01) |
| ***F23C 10/18*** | (2006.01) |
| ***F23C 10/16*** | (2006.01) |

(52) U.S. Cl.
CPC ..... *F23G 5/50* (2013.01); *F23L 5/00* (2013.01); *F23C 2900/10001* (2013.01); *F23C 2900/10002* (2013.01); *F23C 2900/10006* (2013.01); *F23C 2900/99006* (2013.01)

(56) References Cited

U.S. PATENT DOCUMENTS

| | | | | |
|---|---|---|---|---|
| 5,114,682 | A * | 5/1992 | Goelzer | C10G 11/185 422/141 |
| 6,949,224 | B1 * | 9/2005 | Miyoshi | C10J 3/482 422/139 |
| 9,388,817 | B1 * | 7/2016 | Wright | F02B 39/10 |
| 2004/0109853 | A1 * | 6/2004 | McDaniel | A62D 3/02 424/94.6 |

FOREIGN PATENT DOCUMENTS

| | | | |
|---|---|---|---|
| JP | 2989605 | B2 | 12/1999 |
| JP | 2001065844 | A | 3/2001 |
| JP | 200222126 | A | 1/2002 |
| JP | 2007170704 | A | 7/2007 |
| JP | 2008025965 | A | 2/2008 |
| JP | 2008025966 | A | 2/2008 |
| JP | 2010054169 | A | 3/2010 |

OTHER PUBLICATIONS

Translation of JP2010054169 to Shuichi et al. Machine translated on Mar. 9, 2017.*

* cited by examiner

METHOD FOR STARTING UP PRESSURIZED FLUIDIZED BED INCINERATOR SYSTEM

TECHNICAL FIELD

The present invention relates to a method for starting up a pressurized fluidized bed incinerator system for burning a material to be treated such as sewage sludge, biomass, municipal solid wastes, and the like, and more particularly, to a method for starting up a pressurized fluidized bed incinerator system that reduces the exchange frequency of a bed material by preventing cracking of silica sand as a bed material filled up in a bottom portion of the pressurized fluidized bed incinerator, and reduces the consumption of auxiliary fuel used for heating the silica sand as the bed material.

BACKGROUND ART

Conventionally, a pressurized fluidized bed incinerator system is known as incineration facilities where a material to be treated such as sewage sludge, biomass, and municipal solid wastes is burned, utilizing energy of a flue gas exhausted from an incinerator. The pressurized fluidized bed incinerator system comprises a pressurized fluidized bed incinerator for burning the material to be treated and a turbocharger including a turbine rotated by the flue gas exhausted from the pressurized fluidized bed incinerator and a compressor rotated according to the rotation of the turbine to supply a compressed air. The pressurized fluidized bed incinerator system can be self-driven, because the turbine of the turbocharger is driven by the flue gas generated upon the combustion of the material to be treated, and the total amount of required combustion air for the combustion is supplied by the compressed air discharged from the compressor. Since the pressurized fluidized bed incinerator system can be self-driven, it is known that a forced draft blower or an induced draft fan required in a conventional system are not necessary, resulting in reduced running costs.

A method for starting up the pressurized fluidized bed incinerator system was proposed where, after silica sand as a bed material that is filled up in the bottom portion of the pressurized fluidized bed incinerator is heated to about 550° C., sand filtrate water is ejected from the water spray arranged at the top portion of the pressurized fluidized bed incinerator to the silica sand as the bed material, this increases a flue gas generated in the pressurized fluidized bed incinerator, and the combustion air is supplied to the pressurized fluidized bed incinerator (see Non Patent Literature 1, Patent Literatures 1, 2).

CITATION LIST

Non Patent Literature

Non Patent Literature 1: "2007 Journal of the 18th Annual Conference of Japan Society of Material Cycles and Waste Management", Japan Society of Material Cycles and Waste Management, issued on Nov. 1, 2007, pp 579 to 581

Patent Literatures

Patent Literature 1: JP 2007-170704 A
Patent Literature 2: JP 2008-25966 A

SUMMARY OF INVENTION

Technical Problem

However, in the conventional method for starting up a pressurized fluidized bed incinerator system, when the temperature of a pressurized fluidized bed incinerator increases, normal temperature water ejected into the incinerator comes into contact with silica sand as a bed material heated to about 550° C., so that the silica sand as the bed material may crack to be smaller grains, and therefore, the consumption of the silica sand as the bed material may increase.

The method for starting up the pressurized fluidized bed incinerator system described in the Non Patent Literature 1 and Patent Literatures 1, 2 needs to use auxiliary fuel such as heavy oil and town gas in order to maintain the exhaust gas temperature and the exhaust gas flow amount until self-driven operation is completed, and there is a problem of increased consumption of the auxiliary fuel.

Accordingly, a main object of the present invention is to solve such problems.

Solution to Problem

The present invention solving the above problems and the operation and effect thereof are as follows.

The first aspect of the present invention is a method for starting up a pressurized fluidized bed incinerator system including a pressurized fluidized bed incinerator for burning a material to be treated having a water-containing organic substance with silica sand as a bed material filled up in a bottom portion of the pressurized fluidized bed incinerator, a turbocharger having a turbine rotated by a flue gas discharged from the pressurized fluidized bed incinerator and a compressor rotated according to the rotation of the turbine to supply a compressed air as a combustion air to the pressurized fluidized bed incinerator, a start-up blower for supplying the combustion air to the pressurized fluidized bed incinerator, and a heating unit for heating inside the pressurized fluidized bed incinerator, the method comprising:

supplying the combustion air to the pressurized fluidized bed incinerator by driving the start-up blower;

increasing a temperature of a freeboard of the pressurized fluidized bed incinerator by heating the silica sand as the bed material using the heating unit;

increasing the amount of the flue gas by feeding the material to be treated to the pressurized fluidized bed incinerator after the temperature of the freeboard is increased to 750 to 900° C.; and supplying the combustion air to the pressurized fluidized bed incinerator by driving the turbocharger with the flue gas and after that, stopping the operation of the start-up blower.

(Operation and Effect)

The amount of the flue gas is increased by feeding the material to be treated to the pressurized fluidized bed incinerator after the temperature of the freeboard is increased to 750 to 900° C. and the combustion air is supplied to the pressurized fluidized bed incinerator by driving the turbocharger with the flue gas. This prevents the silica sand as the bed material from cracking caused by heat shock so that the exchange frequency of the silica sand as the bed material can be reduced. Further, since the organic substance contained in the material to be treated is burned, the consumption of an auxiliary fuel such as heavy oil and town gas required for the conventional pressurized fluidized bed incinerator can be reduced.

The second aspect of the present invention is according to the first aspect of the present invention wherein with the start-up blower and the turbocharger, a larger amount of the combustion air is supplied to the pressurized fluidized bed incinerator than that of the combustion air used for burning the material to be treated.

(Operation and Effect)

With the start-up blower and the turbocharger, the larger amount of the combustion air is supplied to the pressurized fluidized bed incinerator than that of the combustion air used for burning the material to be treated. Therefore, the material to be treated is burned completely resulting in suppressing the occurrence of a hazardous substance such as carbon monoxide.

The third aspect of the present invention is according to the first or second aspect of the present invention wherein when an incinerator pressure in the pressurized fluidized bed incinerator becomes constant for a predetermined period of time, the feeding of the material to be treated is started.

(Operation and Effect)

When the incinerator pressure in the pressurized fluidized bed incinerator becomes constant for a predetermined period of time, the feeding of the material to be treated is started. Therefore, it is unnecessary to use a water spray or the like for increasing the amount of the flue gas and the operation of the turbocharger can be started in a preferable manner.

The fourth aspect of the present invention is according to the first to third aspect of the present invention wherein after a temperature of the flue gas supplied to the turbine attains a predetermined value, a bypass flow path, which is provided between a branch point from a flow path provided from a discharge-side of the start-up blower to a suction-side of the compressor and a flow path from a discharge-side of the compressor, is blocked so that the combustion air is supplied from the start-up blower via an air flow path to an inlet of the compressor.

(Operation and Effect)

After the temperature of the flue gas at an inlet of the turbocharger attains the predetermined value, the supply of the combustion air from the start-up blower via the turbocharger to the pressurized fluidized bed incinerator is started. Therefore, it is unnecessary to use a water spray or the like for increasing the amount of the flue gas and the operation of the turbocharger can be started in a preferable manner.

The fifth aspect of the present invention is according to the first to fourth aspect of the present invention wherein the material to be treated is fed to the pressurized fluidized bed incinerator, while the amount of the same is increased at a constant rate.

(Operation and Effect)

The material to be treated is fed to the pressurized fluidized bed incinerator, while the amount of the same is increased at a constant rate. Therefore, the change in the temperature of the pressurized fluidized bed incinerator can be suppressed and the operation of the turbocharger can be shifted stably to the self-driven operation.

The sixth aspect of the present invention is according to the first to fourth aspect of the present invention wherein the material to be treated is fed to the pressurized fluidized bed incinerator, while the amount of the same is increased step by step.

(Operation and Effect)

The material to be treated is fed to the pressurized fluidized bed incinerator, while the amount of the same is increased step by step. Therefore, the material to be treated can be fed easily as well as the change in the amount of fed material to be treated is suppressed. Further, the change in the temperature of the pressurized fluidized bed incinerator can be suppressed and the operation of the turbocharger can be shifted stably to the self-driven operation.

The seventh aspect of the present invention is according to the sixth aspect of the present invention wherein the material to be treated is fed at 20 to 30 percent by mass of a rated load of the pressurized fluidized bed incinerator, and after the combustion air supplied from the turbocharger becomes equal to or more than 50 percent by volume of the rated volume, the material to be treated is fed at 40 to 50 percent by mass of the rated load.

(Operation and Effect)

The material to be treated is fed at 20 to 30 percent by mass of a rated load of the pressurized fluidized bed incinerator. Therefore, the decrease in the temperature of the silica sand as the bed material can be prevented when feeding of the material to be treated is started.

After the combustion air supplied from the turbocharger becomes equal to or more than 50 percent by volume of the rated volume, the material to be treated is fed at 40 to 50 percent by mass of the rated load. Therefore, the change in the temperature of the pressurized fluidized bed incinerator can be further suppressed, and the operation of the turbocharger can be shifted shortly to a self-driven operation.

The eighth aspect of the present invention is according to the first to seventh aspect of the present invention wherein the pressurized fluidized bed incinerator comprises a start-up burner and an auxiliary fuel combustion apparatus as the heating units for heating the silica sand as the bed material filled up in the bottom portion, and after the silica sand as the bed material is heated to 650 to 700° C. by the start-up burner, the silica sand as the bed material is heated to 750 to 850° C. by the auxiliary fuel combustion apparatus.

(Operation and Effect)

After the external surface of the silica sand as the bed material is heated by the start-up burner, the internal portion of the same is heated by the auxiliary fuel combustion system. Therefore, the silica sand as the bed material can be heated efficiently, and the consumption of the auxiliary fuel can be suppressed.

Advantageous Effects of Invention

According to the above invention, the material to be treated can be fed even before self-driven operation of a turbocharger, and this can prevent the silica sand as the bed material from cracking at low costs.

DESCRIPTION OF EMBODIMENTS

The embodiment of the present invention will be hereinafter explained in details with reference to appended drawings. For the sake of easy understanding, the direction is indicated for the sake of convenience in the explanation, but it is to be understood that the configuration is not limited thereby.

Figure 1:
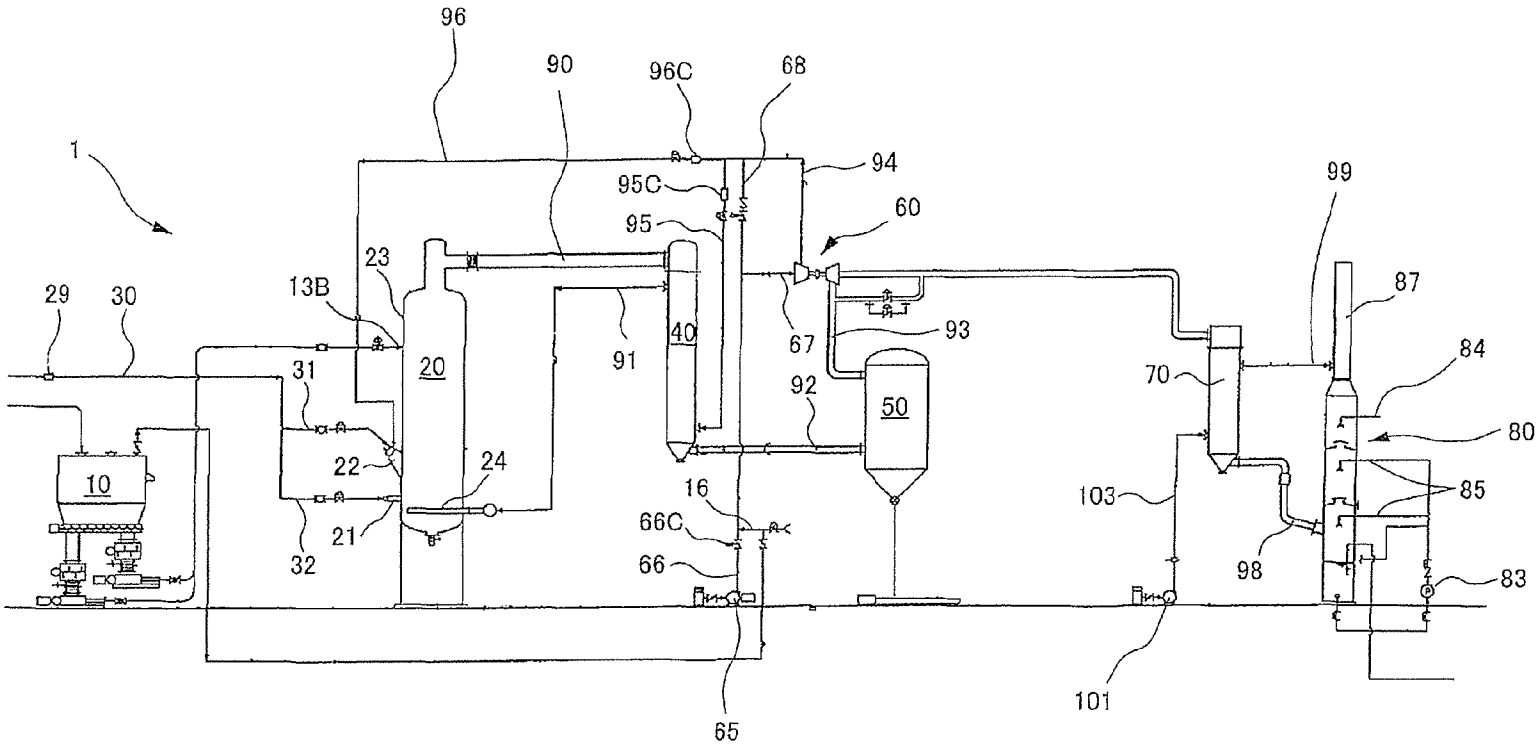
FIG. 1 is an explanatory diagram illustrating a pressurized fluidized bed incinerator system.

As shown in FIG. 1, the pressurized fluidized bed incinerator system 1 comprises a sludge hopper 10 for storing a material to be treated such as sludge, a pressurized fluidized bed incinerator 20 for burning the material to be treated fed from the sludge hopper 10, an air pre-heater 40 for heating a combustion air supplied to the pressurized fluidized bed incinerator 20 by using a flue gas exhausted from the pressurized fluidized bed incinerator 20, a dust collector 50 for removing powder dusts in the flue gas, a turbocharger 60 driven by the flue gas to supply the combustion air to the pressurized fluidized bed incinerator 20, a white smoke prevention pre-heater 70 for heating a white smoke prevention air supplied to a scrubber 80 by using the flue gas discharged from the turbocharger 60, and the scrubber 80 for removing impurities in the flue gas.

(Sludge Hopper)

The material to be treated stored in the sludge hopper 10 is mainly sewage sludge of which water content is dehydrated to 70 to 85 percent by mass, and the material to be treated contains a combustible organic substance. It should be noted that since the material to be treated is not limited to the sewage sludge as long as it is a organic substance containing water, it may be biomass, municipal solid waste, and the like.

At the lower portion of the sludge hopper 10, a constant feeder 11 is provided to supply a predetermined amount of the material to be treated to the pressurized fluidized bed incinerator 20, and at the downstream side of the constant feeder 11, feed pumps 12 are provided to pressure the material to be treated to the pressurized fluidized bed incinerator 20. The feed pump 12 may be a processing cavity pump, a piston pump, and the like.

(Pressurized Fluidized Bed Incinerator)

The pressurized fluidized bed incinerator 20 is a combustion incinerator in which solid particles such as silica sand as a bed material having a predetermined particle size is filled up in the lower portion of the incinerator as fluidized medium, and is configured to burn the material to be treated fed from outside and the auxiliary fuel supplied as necessary while maintaining the fluidized state of a fluidized bed (hereinafter referred to as a sand bed) by using the combustion air supplied into the incinerator. The pressurized fluidized bed incinerator 20 comprises an auxiliary fuel combustion apparatus 21 and/or a start-up burner 22 as a heating unit.

Figure 2:
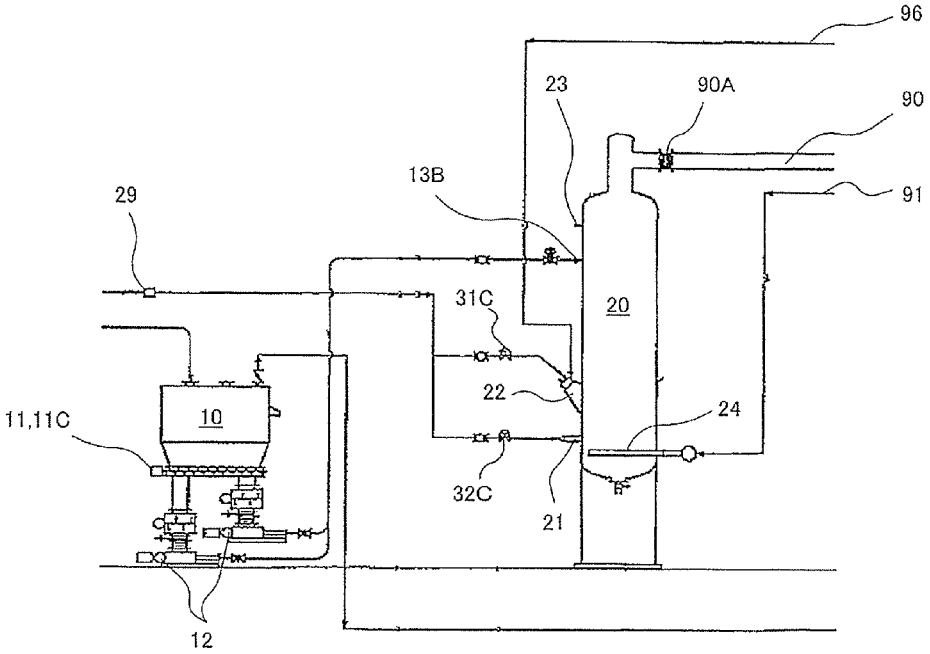
FIG. 2 is a partially enlarged diagram of FIG. 1.

As shown in FIGS. 1 and 2, an auxiliary fuel combustion apparatus 21 is provided in a lower portion of the incinerator at one side wall thereof, to heat the silica sand as the bed material that has the particle size of about 400 to 600 μm and that is filled up in the pressurized fluidized bed incinerator 20. In the vicinity of the auxiliary fuel combustion apparatus 21 at the upper side thereof, a start-up burner 22 is arranged to heat the silica sand as the bed material during the start-up operation. An inlet 13B for the material to be treated is further arranged at the upper side of the start-up burner 22. In the upper portion of the pressurized fluidized bed incinerator 20, a water spray 23 is arranged to cool the flue gas by spraying cooling water into the incinerator as necessary.

The auxiliary fuel combustion apparatus 21 is provided at the upper side of a combustion air diffusion pipe 24 to heat the silica sand as the bed material that is filled up in the pressurized fluidized bed incinerator 20. In the same manner as the combustion air diffusion pipe 24, the auxiliary fuel combustion apparatus 21 comprises multiple pieces arranged in parallel. To the auxiliary fuel combustion apparatus 21, auxiliary fuel such as town gas and heavy oil is supplied from an auxiliary fuel supply apparatus 29 arranged outside the incinerator. As the auxiliary fuel combustion apparatus 21, a gas spray, oil spray or the like also can be applied.

The start-up burner 22 is arranged at the pressurized fluidized bed incinerator 20 so as to incline downwardly toward a central axis thereof for heating the external surface of the silica sand as the bed material during the start-up operation. In the same manner as the auxiliary fuel combustion apparatus 21, to the start-up burner 22, the auxiliary fuel is supplied from the auxiliary fuel supply apparatus 29 arranged outside the incinerator. The air, which has been blown via a pipe 96 from the start-up blower 65, is used as the combustion air for the start-up burner 22.

The combustion air diffusion pipe 24 is arranged in the lower portion of the pressurized fluidized bed incinerator 20 at the other side wall thereof to supply the combustion air into the pressurized fluidized bed incinerator 20. A discharge port 90A is formed on the side wall of a head portion of the pressurized fluidized bed incinerator 20 having the smaller diameter to discharge outside the incinerator the combustion gas generated by combustion of the auxiliary fuel, the material to be treated and the like, water vapor generated by heating of the sand filtrate water, water contained in the material to be treated and the like. In the present invention, the combustion gas or a gas formed by mixing the combustion gas and the water vapor is referred to as the flue gas.

The combustion air diffusion pipe 24 is arranged in the lower portion of the auxiliary fuel combustion apparatus 20 in order to supply uniformly the combustion air to the auxiliary fuel supplied from the auxiliary fuel combustion apparatus 21.

Plural temperature sensors (not shown) are arranged on the side wall of the pressurized fluidized bed incinerator 20 with a predetermined interval along the height direction to measure the temperatures in the incinerator. The positions of these temperature sensors are in the sand bed and in the freeboard, both of which have two to three temperature sensors, namely four to six temperature sensors in total. As the temperature sensor, a thermocouple and the like can be used. In this case, the freeboard means an upper portion over the sand bed in a pressurized fluidized bed incinerator 20. Each temperature sensor outputs, in a control apparatus (not shown), an electric signal indicating the temperature in the incinerator at the position thereof.

(Air Pre-Heater)

The air pre-heater 40 is provided at the rear stage of the pressurized fluidized bed incinerator 20, and heats the combustion air to a predetermined temperature by indirectly exchanging heat between the combustion air and the flue gas discharged from the pressurized fluidized bed incinerator 20.

Figure 3:
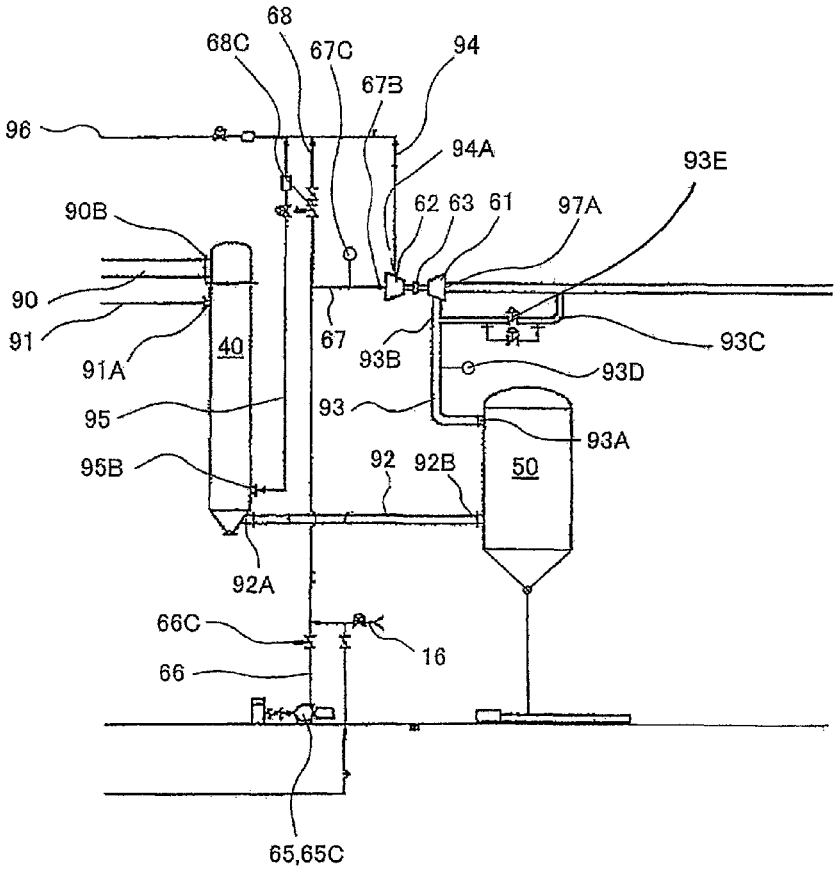
FIG. 3 is a partially enlarged diagram of FIG. 1.

As shown in FIGS. 1 and 3, an inlet 90B for the flue gas flown from the pressurized fluidized bed incinerator 20 is formed in the upper portion of the air pre-heater 40 at one side wall thereof, and an outlet 91A for discharging the combustion air from the air pre-heater 40 is formed in the vicinity of the inlet 90B at the lower side thereof. The inlet 90B of the flue gas is connected to the discharge port 90A of the pressurized fluidized bed incinerator 20 via the pipe 90. The outlet 91A for the combustion air is connected to a base portion of the combustion air diffusion pipe 24 in the pressurized fluidized bed incinerator 20 via the pipe 91.

An outlet 92A is formed in the lower portion of the air pre-heater 40 at the other side thereof to discharge the flue gas from the air pre-heater 40. In the vicinity of the outlet 92A at the upper side thereof, an inlet 95B is formed to supply the combustion air into the pre-heater. The air pre-heater is preferably a shell and tube heat exchanger.

(Dust Collector)

The dust collector 50 is provided at the rear stage of the air pre-heater 40, and removes impurities such as fully fined silica sand and dusts contained in the flue gas blown from the air pre-heater 40.

A filter arranged in the dust collector 50 may be, for example, a ceramic filter and a bug filter. An inlet 92B is formed in the lower portion of the dust collector 50 at one side wall thereof to supply the flue gas thereinto, and an outlet 93A is formed in the upper portion thereof to discharge a clean flue gas outside the dust collector, from which impurities and the like have been removed. The inlet 92B for the flue gas is connected to the outlet 92A for the flue gas of the air pre-heater 40 via the pipe 92.

A filter (not shown) is arranged in the dust collector 50 in the midway in the up down direction thereof between the inlet 92B arranged at the lower portion thereof and the outlet 93A arranged at the upper portion thereof. The impurities and the like in the flue gas removed through the filter are temporarily saved in the bottom portion in the dust collector 50 so as to be discharged outside periodically.

(Turbocharger)

The turbocharger 60 is arranged at the rear stage of the dust collector 50, and comprises a turbine 61 rotated by the flue gas blown from the dust collector 50, a shaft 63 for transmitting rotation of the turbine 61, and a compressor 62 for generating the compressed air when the rotation is transmitted by the shaft 63 to the compressor 62. The generated compressed air is supplied, as the combustion air, to the pressurized fluidized bed incinerator 20.

An inlet 93B is formed in a lower portion of the turbocharger 60 at the turbine 61-side wall thereof (at which a perpendicular line intersects to the shaft 63) to supply into the turbocharger, a clean flue gas from which the impurities have been removed by the dust collector 50. An outlet 97A is formed in a downstream side of the turbocharger at the turbine 61-side wall thereof (in parallel with the shaft 63) to discharges the flue gas outside the turbocharger. The inlet 93B for the flue gas is connected to the outlet 93A of the dust collector 50 via the pipe 93. A temperature measuring unit 93D is arranged in the pipe 93 to measure the flue gas temperature.

An inlet 67B is formed in the upstream side of the turbocharger 60 at the compressor 62-side wall thereof (in parallel with the shaft 63) to suction the air into the turbine. A discharge port 94A is formed in the upper side of the turbocharger at the turbine 61-side wall thereof (at which a perpendicular line intersects to the shaft 63) to discharge, outside the turbocharger, the compressed air, which has been made by compressed the sucked air to 0.05 to 0.3 MPa. The inlet 67B for the outside air sucks the air via pipes 16, 67. In addition, it is also connected via the pipes 66, 67 to the start-up blower 65, which supplies the combustion air to the pressurized fluidized bed incinerator 20 during the start-up operation. In the pipe 67, a pressure detection unit 67C is arranged to measure the pressure in the pipe. On the other hand, the discharge port 94A for the compressed air is connected to the inlet 95B of the air pre-heater 40 via the pipes 94, 95 and to the rear portion of the start-up burner 22 of the pressurized fluidized bed incinerator 20 via the pipes 94, 96.

(Start-Up Blower)

The start-up blower 65 supplies the fluidized air to the pressurized fluidized bed incinerator 20 and the combustion air to the start-up burner 22 during the start-up operation of the pressurized fluidized bed incinerator system 1. The start-up blower 65 also has a function of forcibly supplying the outside air to the compressor 62 in order to cope with decreased suction of the outside air by the compressor 62, which is caused by decreased water vapor generated in the pressurized fluidized bed incinerator 20 and whereby the reduced rotation speed of the turbine 61 of the turbocharger 60, when for example, the feeding is stopped of the material to be treated from the sludge hopper 10.

The start-up blower 65 is connected to the outlet-side pipe 94 of the compressor 62 via the pipes 66, 68. The start-up blower 65 is further connected to the rear portion of the start-up burner 22 arranged at the pressurized fluidized bed incinerator 20 via the pipes 94, 96, connected to the inlet 95B for the combustion air of the air pre-heater 40 via the pipes 94, 95, and connected to the inlet 67B of the compressor 62 of the turbocharger 60 via the pipes 66, 67.

At the midway of the pipe 68 as a bypass flow path, a dumper 68C is arranged to allow communication at a site in the pipe 68, which is away from the connection point with the pipe 67 when seen from the start-up blower 65. The dumper 68C allows communication through the pipe 68 from the start-up operation of the pressurized fluidized bed incinerator 20 (namely the ignition of the start-up burner 22) to completion of heating of the pressurized fluidized bed incinerator 20, and shuts off the communication through the pipe 68 after the completion of heating of the pressurized fluidized bed incinerator 20. More specifically, from the start-up operation of the pressurized fluidized bed incinerator 20 to the completion of heating of the pressurized fluidized bed incinerator 20, the air generated by the start-up blower 65 is supplied as the combustion air for the start-up burner, via the pipe 96, to the start-up burner 22 arranged at the pressurized fluidized bed incinerator 20. Further, the combustion air is supplied, via the pipe 95 and the air pre-heater 40, to the combustion air diffusion pipe 24. Still further, the combustion air is supplied, via the pipe 67 which is a non-closed air flow path, to the turbocharger 60 at the compressor 62-side thereof. Finally, after the completion of heating of the pressurized fluidized bed incinerator 20, the dumper 68C is closed so that only the air having passed through the compressor 62 is supplied as the combustion air, via the air pre-heater 40, to the combustion air diffusion pipe 24 of the pressurized fluidized bed incinerator 20.

(White Smoke Prevention Pre-Heater)

The white smoke prevention pre-heater 70 indirectly exchanges heat between the flue gas discharged from the turbocharger 60 and the white smoke prevention air supplied from the white smoke prevention fan in order to prevent generation of white smoke of the flue gas discharged outside from the stack 87. With the heat exchange, the flue gas is cooled while the white smoke prevention air is heated. The flue gas that has been heat-exchanged and cooled by the white smoke prevention pre-heater 70 is blown to the scrubber 80 provided at the rear stage of white smoke prevention pre-heater. The white smoke prevention pre-heater 70 may be a shell and tube heat exchanger, a plate heat exchanger, or the like.

(Scrubber)

The scrubber 80 prevents, for example, the impurities contained in the flue gas from being discharged. The stack 87 is provided at the top of the scrubber 80.

Figure 4:
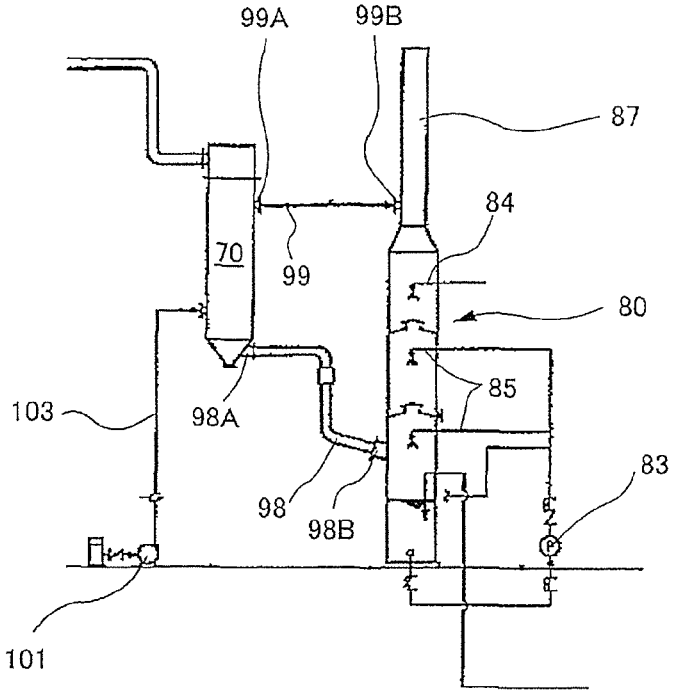
FIG. 4 is a partially enlarged diagram of FIG. 1.

As shown in FIGS. 1 and 4, an inlet 98B is formed in the lower portion of the scrubber 80 at one side wall thereof to supply the flue gas discharged from the white smoke prevention pre-heater 70 into the scrubber, and a inlet 99B is formed in the lower portion of the stack 87 at one side thereof to supply, into the stack 87, the white smoke prevention air which has been heated by heat exchange with the flue gas and discharged from the white smoke prevention pre-heater 70. The inlet 98B for the flue gas is connected to the outlet 98A for the flue gas formed in the lower portion of the white smoke prevention pre-heater 70 via the pipe 98. The inlet 99B for the white smoke prevention air is connected to an outlet 99A for the white smoke prevention air formed in the upper portion of the white smoke prevention pre-heater 70 via the pipe 99.

The white smoke prevention air of the white smoke prevention pre-heater 70 is supplied to the white smoke prevention pre-heater 70 via the pipe 103 by the white smoke prevention air blower 101, and is indirectly heat-exchanged with the flue gas so as to be heated and discharged through the outlet 99A. In the stack 87, the heated and dried white smoke prevention air is mixed at the inlet 99B with the flue gas at the exit which is wet and tends to be condensed in air and atomized so that the relative humidity of the flue gas is reduced for preventing the white smoke.

A spray tube 84 is arranged in the upper portion of the scrubber 80 at the other side wall thereof to spray water, which has been supplied from the outside. Spray tubes 85 are arranged at the middle portion and lower portion of the scrubber via a circulation pump 83 to spray inside the scrubber caustic soda solution saved in the bottom portion of the scrubber 80. The caustic soda solution saved in the scrubber 80 is supplied from a caustic soda tank, not shown, via a caustic soda pump, not shown while the amount of caustic soda solution is constantly maintained to be appropriate.

The flue gas is supplied to the scrubber 80 where the impurities and the like are removed from the flue gas and the white smoke prevention air and the flue gas are mixed so as to be discharged outside from the stack 87.

Subsequently, the method for starting up the pressurized fluidized bed incinerator system will be explained.

(Method for Starting Up Pressurized Fluidized Bed Incinerator System)

Figure 5:
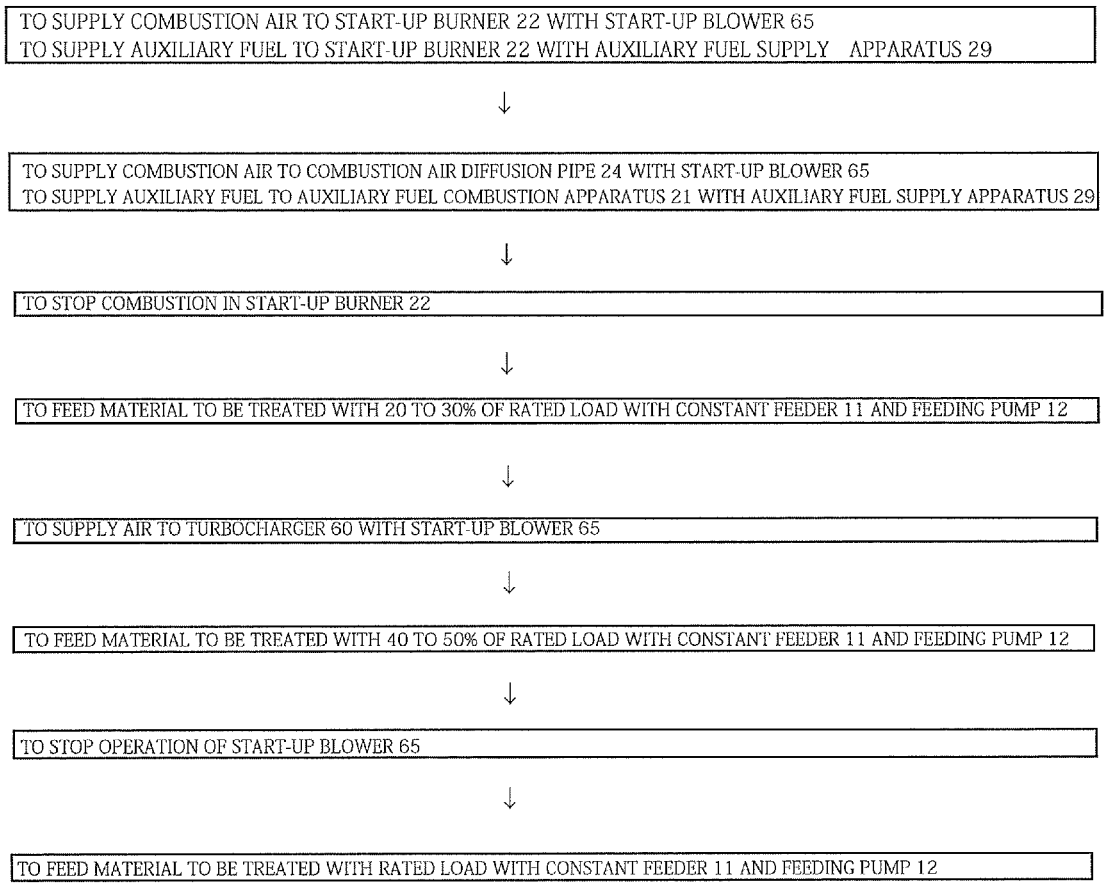
FIG. 5 is a flowchart illustrating a start up method according to an embodiment of the present invention.

The method for starting up the pressurized fluidized bed incinerator system 1 according to the present embodiment will be explained with reference to FIG. 5. By the method for starting up, the silica sand as the bed material can be prevented from cracking when it is rapidly cooled by water sprayed by the water spray 23.

The start-up blower 65 sucking the outside air is started up, and the combustion air is supplied from the start-up blower 65 to the start-up burner 22. The combustion air discharged from the start-up blower 65 is supplied to the rear portion of the start-up burner 22 via the pipes 66, 68, 96. A dumper 66C arranged in the pipe 66 is connected to the control apparatus and opened while the start-up blower 65 operates so as to allow communication through the pipe 66. The dumper 68C is arranged to allow communication at a site in the pipe 68, which is away from the connection point with the pipe 67 when seen from the start-up blower 65. The dumper 68C is connected to the control apparatus to allow communication through the pipe 68. In this case, the combustion air discharged from the start-up blower 65 may be partly to the start-up burner 22 via the compressor 62 of the turbocharger 60 and the pipe 94 in some cases, but it is enough that more than half of the combustion air discharged from the start-up blower 65 is supplied to the start-up burner 22 without passing through the compressor 62.

The auxiliary fuel supply apparatus 29 arranged outside the incinerator is started up, and the auxiliary fuel such as heavy oil and town gas is supplied from the auxiliary fuel supply apparatus 29 to the start-up burner 22. The auxiliary fuel discharged from the auxiliary fuel supply apparatus 29 is supplied to the rear portion of the start-up burner 22 via the pipes 30, 31. A flow control valve 31C arranged in the pipe 31 is connected to a control apparatus (not shown) to control the amount (supply amount) of the auxiliary fuel.

The auxiliary fuel and the combustion air supplied to the start-up burner 22 are mixed and burnt with the start-up burner 22 so that hot air is ejected from the forward end of the start-up burner 22. The hot air ejected from the start-up burner 22 is sprayed toward the external surface of the silica sand as the bed material that fills up in the bottom portion of the pressurized fluidized bed incinerator 20, whereby the temperature of the sand bed is increased to about 650 to 700° C.

Subsequently, the combustion air is supplied from the start-up blower 65 to the combustion air diffusion pipe 24. The combustion air discharged from the start-up blower 65 is supplied to the rear portion of the combustion air diffusion pipe 24 via the pipes 66, 68, 96, 95, the air pre-heater 40, and the pipe 91. The flow control valve 95C arranged in the pipe 95 is connected to the control apparatus to allow communication through the pipe 95 so that an appropriate amount of combustion gas can flow there. In this case, the combustion air discharged from the start-up blower 65 may be partly to the combustion air diffusion pipe 24 via the compressor 62 of the turbocharger 60 and the pipe 94 in some cases, but it is enough that more than half of the combustion air discharged from the start-up blower 65 is supplied to the combustion air diffusion pipe 24 without passing through the compressor 62.

The auxiliary fuel is supplied from the auxiliary fuel supply apparatus 29 to the auxiliary fuel combustion apparatus 21. The auxiliary fuel discharged from the auxiliary fuel supply apparatus 29 is supplied to the rear portion of the auxiliary fuel combustion apparatus 21 via the pipes 30, 32. A flow control valve 32C arranged in the pipe 32 is connected to a control apparatus (not shown) to control the amount (supply amount) of the auxiliary fuel.

The combustion air supplied to the combustion air diffusion pipe 24 is discharged from a hole of the forward end of the combustion air diffusion pipe 24 to a packed bed of the silica sand as the bed material, and the auxiliary fuel supplied to the auxiliary fuel combustion apparatus 21 is discharged from the hole of the forward end of the auxiliary fuel combustion apparatus 21 to the packed bed of the silica sand as the bed material, and the combustion air and the auxiliary fuel are mixed and burnt in voids of the silica sand as the bed material so that the hot air is generated for increasing the temperature of the silica sand as the bed material to 750 to 850° C. The freeboard temperature of the pressurized fluidized bed incinerator 20 (the temperature of the upper portion of the pressurized fluidized bed incinerator 20) is increased to about 850° C. along with the increase in the temperature of the bed material. The flue gas exhausted from the pressurized fluidized bed incinerator 20 is supplied via the pipe 90 to the air pre-heater 40, and thereafter, passes the dust collector 50. The flue gas discharged from the dust collector 50 is supplied via the pipe 93C to the scrubber 80, and thereafter, is discharged outside through the stack 87. In this case, the flue gas may be partly supplied to the turbine 61 of the turbocharger 60.

Subsequently, after stabilization of the combustion caused in the voids of the silica sand as the bed material by the combustion air supplied from the combustion air diffusion pipe 24 and the auxiliary fuel supplied from the auxiliary fuel combustion apparatus 21, the combustion in the start-up burner 22 is stopped. More specifically, the dumper 96C of the pipe 96 is disconnected from the control apparatus, and the pipe 96 is closed to stop the supply of the combustion air, and the flow control valve 31C of the pipe 31 is closed to stop the supply of the auxiliary fuel.

After the temperature of the freeboard in the pressurized fluidized bed incinerator 20 increases to about 750 to 900° C., when the amount of the combustion air and the pressure in the incinerator are constant for about one to ten seconds, the constant feeder 11 and a feeding pump 12 are started up, and the material to be treated is fed into the pressurized fluidized bed incinerator 20 from the inlet 13B thereof. The organic substance contained in the material to be treated fed into the pressurized fluidized bed incinerator 20 is burnt and combustion gas is generated, and the water contained in the material to be treated comes into contact with the upper portion or the silica sand as the bed material of the pressurized fluidized bed incinerator 20, so that the water is boiled so as to generate water vapor.

As described above, since the feeding of the material to be treated is started after the amount of the combustion air supplied to the pressurized fluidized bed incinerator 20 and the pressure therein become constant, sudden changes in the condition of the incinerator can be suppressed.

The amount of the fed material to be treated is preferably 20 to 30% of the rated load of the pressurized fluidized bed incinerator 20. When it is less than 20% of the rated load, the amount of flue gas generates is small, and it takes a long time until the operation of the turbocharger 60 is shifted to the self-driven operation. When the amount of supply is more than 30% of the rated load, the silica sand would crack because of water contained in the material to be treated, and the reduction in the diameters of the particles cannot be sufficiently prevented. The rated load means the mass of the material to be treated fed from the inlet 13B to the pressurized fluidized bed incinerator 20 while the turbocharger 60 is self-driven.

When the flue gas temperature detected by the temperature measuring unit 93D arranged in the pipe 93 in the vicinity of the inlet 93B for the flue gas of the turbocharger 60 reaches 500 to 650° C., a dumper 93E arranged in the pipe 93C is driven in the closing direction, and the flue gas is supplied to the turbine 61 of the turbocharger 60, and the turbine 61 is rotated. On the other hand, the compressor 62 of the turbocharger 60 starts the rotation according to the rotation of the turbine 61.

Subsequently, according to the rotation of the turbine 61, the combustion air is supplied from the start-up blower 65 to the compressor 62. The combustion air discharged from the start-up blower 65 is supplied to the compressor 62 via the pipes 66, 67. In addition, the outside air can be supplied to the compressor 62 as the combustion air via the pipes 16, 66, 67. The pressure of the supplied combustion air is increased to 0.05 to 0.3 Mpa by the compressor 62, and thereafter, the supplied combustion air is supplied to the rear portion of the combustion air diffusion pipe 24 via the pipes 94, 96, 95, the air pre-heater 40, and the pipe 91. The dumper 68C is closed, which is arranged in the pipe 68 served as a bypass flow. When the pipe 68 served as the bypass flow path is closed in this way, all the combustion air discharged from the start-up blower 65 is supplied to the compressor 62 via the pipe 67 served as the air flow path.

Subsequently, after the combustion air discharged from the compressor 62 of the turbocharger 60 becomes equal to or more than 50% of the rated volume, an amount of the material to be treated less than the rated load is fed into the pressurized fluidized bed incinerator 20 from the inlet 13B thereof. The amount of fed material to be treated is preferably 40 to 50% of the rated load. When the amount of fed material into the pressurized fluidized bed incinerator 20 is set to be 40 to 50% of the rated load, this increases the flue gas and the water vapor generated from the material to be treated, and the amount of combustion air discharged from the turbocharger 60 can be increased in a relatively short time. The rated volume means the amount of the combustion air required for burning the rated load of the material to be treated in the pressurized incinerator 20.

When the amount of supply of the material to be treated is less than 40% of the rated load, the amount of flue gas generated is small, and it takes a longer time for the amount of the combustion air discharged from the turbocharger 60 to increase to the predetermined amount. On the other hand, when the amount of supply is more than 50% of the rated load, the temperature of the bed material in the pressurized fluidized bed incinerator 20 is difficult to be maintained at a constant level because of the water contained in the material to be treated.

When the material to be treated is supplied and the flue gas is increased, the rotation speed of the turbocharger 60 is increased, thereby the amount of the air the compressor 62 is able to suck is increased. Thus, while the amount of the combustion air supplied to the compressor 62 of the turbocharger 60 via the pipes 16, 66, 67 is increased, the amount of the combustion air supplied from the start-up blower 65 can be decreased. In order to control the amount of the combustion air, the rotation speed of the blower may be reduced, or the opening of the dumper 66C may be adjusted. Thereafter, when the pressure measured by the pressure detection unit 67C arranged in the pipe 67 becomes less than the atmospheric pressure, the operation of the start-up blower 65 is stopped. As a result, the pressurized fluidized bed incinerator system 1 can be self-driven by using the flue gas for driving the turbine 61 and by using the compressed air discharged from the compressor 62 for supplying the total amount of required combustion air for burning the material to be treated.

After the combustion air discharged from the compressor 62 of the turbocharger 60 becomes equal to or more than 85% of the rated volume, the rated load of the material to be treated is fed into the pressurized fluidized bed incinerator 20. After the combustion air becomes equal to or more than 85% of the rated volume, the amount of the fed material to be treated is set to be the rated load, so that this suppresses the change in the temperature and the pressure in the pressurized fluidized bed incinerator 20, resulting in a stable combustion state in the pressurized fluidized bed incinerator 20 and a stable amount of the discharged flue gas.

In another possible embodiment, the operation of the start-up blower 65 may be stopped as follows. Even if the pressure measured by the pressure detection unit 67C arranged in the pipe 67 becomes less than the atmospheric pressure, the operation of the start-up blower 65 is not stopped immediately. Instead, after the combustion air discharged from the compressor 62 of the turbocharger 60 becomes equal to or more than 85% of the rated volume and then the rated load of the material to be treated is fed into the pressurized fluidized bed incinerator 20, the operation of the start-up blower 65 is stopped.

(Another Method for Starting Up Pressurized Fluidized Bed Incinerator System)

Figure 6:
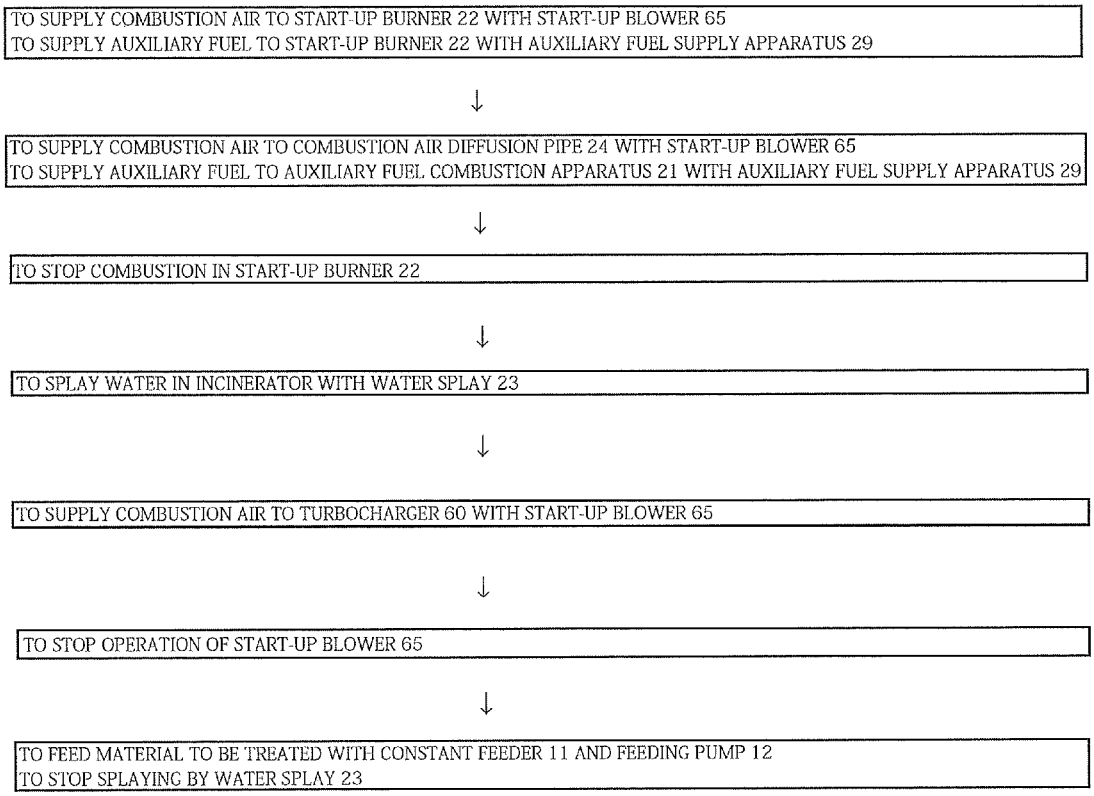
FIG. 6 is a flowchart illustrating a start up method according to a comparative embodiment.

Next, another method for starting up the pressurized fluidized bed incinerator system 1 will be explained as a comparative example with reference to FIG. 6. Until the combustion in the start-up burner 22 is stopped when the freeboard temperature of the pressurized fluidized bed incinerator 20 increases to about 850° C., the starting up method employs the same way as the start up method explained above, and therefore, explanation therefore is omitted.

After the temperature of the freeboard is increased to about 850° C., a sand filtrate water pump (not shown) is started up, so that water is supplied from the sand filtrate water pump to the water spray 23. The water supplied to the water spray 23 is sprayed from the water spray 23 to the silica sand as the bed material, and the water comes into contact with the freeboard or the silica sand as the bed material of the pressurized fluidized bed incinerator 20, so that the water is boiled so as to generate water vapor.

The flue gas containing, in a mixed manner, the water vapor generated from boiling water and the flue gas generated by the combustion of the auxiliary fuel and the combustion air in the pressurized fluidized bed incinerator 20 is supplied via the pipe 90, the air pre-heater 40, the pipe 92, the dust collector 50, and the pipe 93 to the turbine 61 of the turbocharger 60, whereby this rotates the turbine 61. On the other hand, the compressor 62 of the turbocharger 60 starts rotation according to the rotation of the turbine 61.

Subsequently, according to the start of the rotation of the turbine 61, the combustion air is supplied from the start-up blower 65 to the compressor 62. The combustion air discharged from the start-up blower 65 is supplied via the pipes 66, 67 to the compressor 62, and after the pressure of the combustion air is increased to 0.05 to 0.3 MPa by the compressor 62, the combustion air is supplied via the pipes 94, 96, 95, the air pre-heater 40, and the pipe 91 to the rear portion of the combustion air diffusion pipe 24. The dumper 68C arranged in the pipe 68 is closed.

Then, the amount of the air sucked by the compressor 62 from the outside is increased, along with the increase of the flue gas, to a required level for burning the material to be treated in the compressor 62. Thus, the operation of the start-up blower 65 is stopped.

Further, by starting up the constant feeder 11 and the feeding pump 12 for the sludge hopper 10, the material to be treated is fed into the pressurized fluidized bed incinerator 20 from the inlet 13B thereof. Thereafter, the supply of the sand filtrate water to the water spray 23 is stopped.

In the other start up method, cracking of the silica sand as the bed material was found. However, in the starting up method according to the present invention stated before, such cracking cannot be found.

REFERENCE SIGNS LIST

1 pressurized fluidized bed incinerator system
10 sludge hopper
11 constant feeder
12 feeding pump
20 pressurized fluidized bed incinerator
21 auxiliary fuel combustion apparatus
22 start-up burner
24 combustion air diffusion pipe
29 auxiliary fuel supply apparatus
40 air pre-heater
50 dust collector
60 turbocharger
61 turbine
62 compressor
65 start-up blower
70 white smoke prevention pre-heater
80 scrubber

The invention claimed is:

1. A method for starting up a pressurized fluidized bed incinerator system including a pressurized fluidized bed incinerator for burning a material to be treated having a water-containing organic substance with silica sand as a bed material filled up in a bottom portion of the pressurized fluidized bed incinerator, a turbocharger having a turbine rotated by a flue gas discharged from the pressurized fluidized bed incinerator and a compressor rotated according to the rotation of the turbine to supply a compressed air as a combustion air to the pressurized fluidized bed incinerator, a start-up blower for supplying the combustion air to the pressurized fluidized bed incinerator, and a heating unit for heating inside the pressurized fluidized bed incinerator, the method comprising:

supplying the combustion air to the pressurized fluidized bed incinerator by driving the start-up blower;

increasing a temperature of a freeboard of the pressurized fluidized bed incinerator by heating the silica sand as the bed material using the heating unit;

increasing the amount of the flue gas by feeding the material to be treated to the pressurized fluidized bed incinerator after the temperature of the freeboard is increased to between 750 to 900° C.;

after a temperature of the flue gas at an inlet of the turbine in the turbocharger reaches between 500 to 650° C., driving a dumper in a closing direction, the dumper being arranged in a pipe, which connects the inlet of the turbine in the turbocharger and a downstream side of the turbine, a bypass flow path, which is provided between a first flow path and a second flow path, the first flow path provided between a discharge-side of the start-up blower and a suction-side of the compressor, and the second flow path provided between a discharge-side of the compressor and an intake side of the pressurized fluidized bed incinerator, is blocked so that the combustion air is supplied from the start-up blower via the first flow path to an inlet of the compressor, and supplying the combustion air to the pressurized fluidized bed incinerator by driving the turbocharger with the flue gas and after supplying the combustion air to the pressured fluidized bed incinerator, stopping the operation of the start-up blower.

2. The method for starting up the pressurized fluidized bed incinerator system according to claim 1, wherein the material to be treated is fed to the pressurized fluidized bed incinerator, while an amount of the material to be treated is increased at a constant rate over time.

3. The method for starting up the pressurized fluidized bed incinerator system according to claim 1, wherein the material to be treated is fed to the pressurized fluidized bed incinerator, while an amount of the material to be treated is increased step by step over time.

4. The method for starting up the pressurized fluidized bed incinerator system according to claim 1, wherein the pressurized fluidized bed incinerator comprises a start-up burner and an auxiliary fuel combustion apparatus as the heating unit for heating the silica sand as the bed material filled up in the bottom portion, and wherein after a temperature of the silica sand as the bed material is heated to between 650 to 700° C. by the start-up burner, the temperature of the silica sand as the bed material is heated to between 750 to 850° C. by the auxiliary fuel combustion apparatus.

* * * * *